US011454469B2

(12) United States Patent
Nilson et al.

(10) Patent No.: US 11,454,469 B2
(45) Date of Patent: Sep. 27, 2022

(54) FIREARM GRIP

(71) Applicant: Atlas Gunworks Inc, North Ferrisburgh, VT (US)

(72) Inventors: Adam W Nilson, Shelburne, VT (US); Tod A West, Vergennes, VT (US)

(73) Assignee: Atlas Gunworks, Inc, Shelburne, VT (US)

( * ) Notice: Subject to any disclaimer, the term of this patent is extended or adjusted under 35 U.S.C. 154(b) by 0 days.

(21) Appl. No.: 17/328,545

(22) Filed: May 24, 2021

(65) Prior Publication Data

US 2021/0381788 A1 Dec. 9, 2021

Related U.S. Application Data

(60) Provisional application No. 63/033,965, filed on Jun. 3, 2020.

(51) Int. Cl.
*F41A 11/02* (2006.01)
*F41C 23/10* (2006.01)

(52) U.S. Cl.
CPC ..... *F41A 11/02* (2013.01); *F41C 23/10* (2013.01)

(58) Field of Classification Search
CPC ..... F41A 11/02; F41C 23/10
See application file for complete search history.

(56) References Cited

U.S. PATENT DOCUMENTS

| | | | | |
|---|---|---|---|---|
| 4,520,585 | A * | 6/1985 | Barrett | F41C 23/10 42/7 |
| 7,743,542 | B1 * | 6/2010 | Novak | F41A 9/24 42/49.02 |
| 8,156,677 | B2 * | 4/2012 | Glock | F41C 23/10 42/71.01 |
| 8,584,390 | B1 * | 11/2013 | Fraher | F41C 23/10 42/71.02 |
| 9,074,831 | B2 * | 7/2015 | Glock | F41C 23/10 |
| 9,777,984 | B1 * | 10/2017 | Bonine | F41C 23/10 |
| 10,203,177 | B2 * | 2/2019 | Chavez | F41C 23/10 |
| 10,731,936 | B1 * | 8/2020 | Sapio | F41A 11/00 |
| 11,320,234 | B1 * | 5/2022 | Simon | F41A 3/66 |
| 2020/0049450 | A1 * | 2/2020 | Willits | F41C 23/10 |

* cited by examiner

*Primary Examiner* — Joshua T Semick

(57) ABSTRACT

A modular grip device for a firearm. The modular grip is designed to be removable from a firearm's frame. The modular grip is designed with recesses on both sides of the grip. Removable panels are designed to fit into the recesses, with a beveled edge securing an edge of each panel to a undercut surface in the modular grip. A trim ring is affixed to an end of the modular grip, with a coaxial hole designed into the grip and trim ring, which is designed to receive a retaining pin.

20 Claims, 10 Drawing Sheets

FIREARM GRIP

CROSS-REFERENCE TO RELATED APPLICATION

This non-provisional application claims priority to U.S. provisional application No. 63/033,965, filed Jun. 3, 2020

FEDERALLY-SPONSORED RESEARCH

None

BACKGROUND

The field of the present application relates generally to devices that improve the use and operation of firearms, including rifles and handguns. In particular, it pertains attributes such as the size, shape, weight, material, or texture of a firearm modular grip, and the ability for a user to readily change such attributes of a firearm modular grip.

BRIEF SUMMARY

In general, aspects of the currently disclosed firearm device may include a modular grip, detachable from a frame. A first recess on a first side of the modular grip may be capable of receiving first and second grip panels and, with a second recess on a second side of the modular grip capable of receiving a grip panel.

A first grip panel may be removably affixed into a first recess, and a second grip panel removably affixed into a second recess. A trim ring may encompass the modular grip's distal end. A trim ring lip may engage both with a first grip panel tab on a distal end of the first grip panel, with a second grip panel tab on a distal end of the second grip panel.

The proximal end of the first grip panel may include a beveled surface which engages with a corresponding undercut beveled surface in a proximal end of the first recess; and the proximal end of the second grip panel may include a beveled surface which engages with a corresponding undercut beveled surface in a proximal end of the second recess. The modular grip may include a grip tab which engages with a grip tab recess on the trim ring. Both the trim ring and the modular grip may contain coaxial holes capable of receiving a retaining pin, and the retaining pin may secure the trim ring to the modular grip in conjunction with a grip tab and grip tab recess.

In general, aspects of the present disclosure may include a method of customizing a firearm device, such as detachably mounting a modular grip to a frame; affixing a removable first grip panel into a first recess on a first side of the modular grip; affixing a removable a second grip panel into a second recess on a second side of the modular grip; the first recess and second recess positioned on opposing sides of the modular grip; and affixing a removable trim ring to the modular grip's distal end.

In an embodiment, the first grip panel and the second grip panel may be installed and removed without the use of tools. In an embodiment, the first and second grip panels are selected to according to volume. In an embodiment, the first and second grip panels are selected to according to weight. In an embodiment, the first and second grip panels are selected to according to surface texture. In an embodiment, the first and second grip panels are selected to according to shape. In an embodiment, the first and second grip panels are selected to according to material type.

DETAILED DESCRIPTION

Firearm designs include those in which a modular grip is removable from the firearm frame. The design of a grip separate from a pistol frame allows users to change both grip size and material. However, the changing of a modular grip is typically a complex procedure that is performed by a firearm manufacturer, rather than by a user. Thus expense of purchasing an additional modular grip and the complexity of changing it are problematic. An alternate design includes a non-removable/non-modular grip with removable grip panels that allows a user to adjust the size of the overall grip for best hand fit. These panels available are in different sizes and may allow shooters with different hand sizes to adjust the fit of a single firearm.

Removable grip panels may also allow users the opportunity for different textures allowing the same firearm to be used for different applications. The ability to have grip panels made from different materials may also allow the user to adjust the balance of the gun and potentially reduce recoil by adding weight to the non-reciprocating grip. Therefore a need exists for a modular grip with interchangeable grip panels, where the grip panels can easily be replaced by a user, without the need for an entire grip change. The present disclosure describes a device which may be suited to either a handgun or a rifle.

Figure 1:
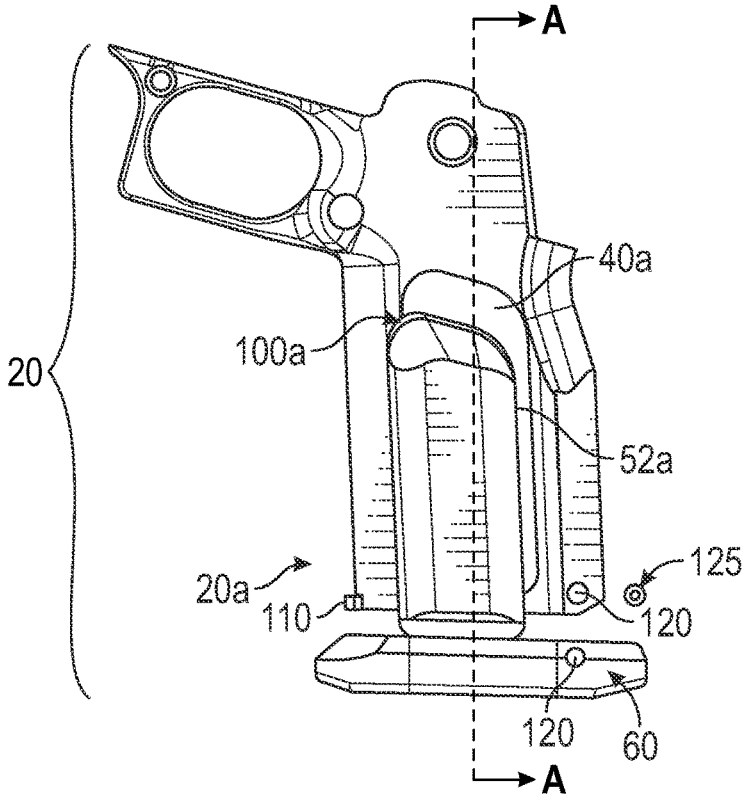
FIG. 1 shows an exploded right side view of a grip, grip panel, trim ring, and retaining pin.
Figure 2:
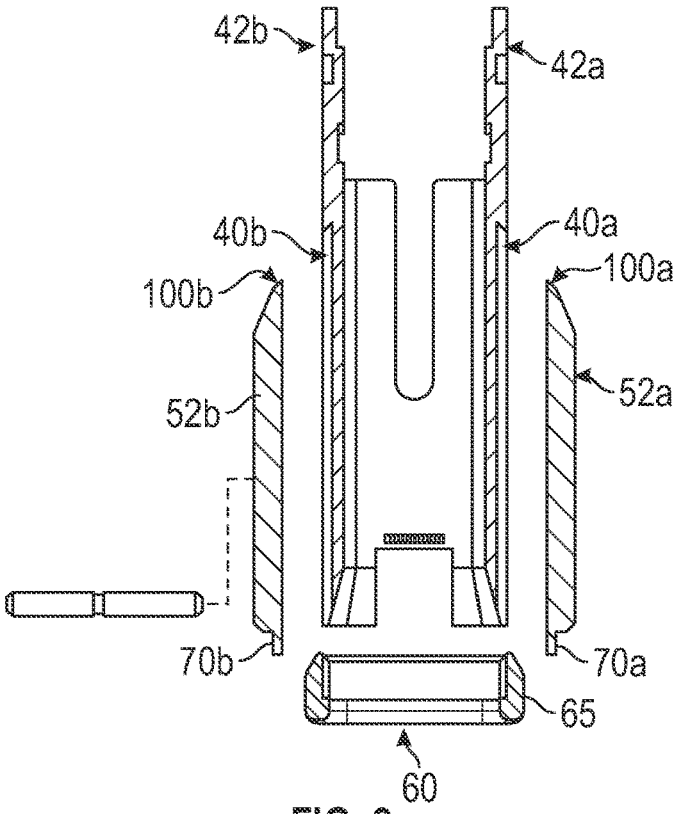
FIG. 2 shows an exploded front view cross section of a grip, grip panels, trim ring, and retaining pin, with reference to FIG. 1.
Figure 3:
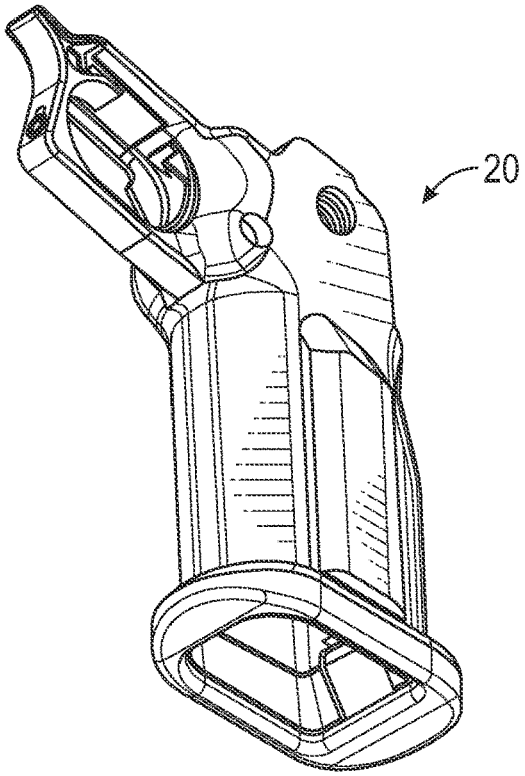
FIG. 3 shows a lower right side perspective view of an assembled grip, grip panel, trim ring, and retaining pin.
Figure 4:
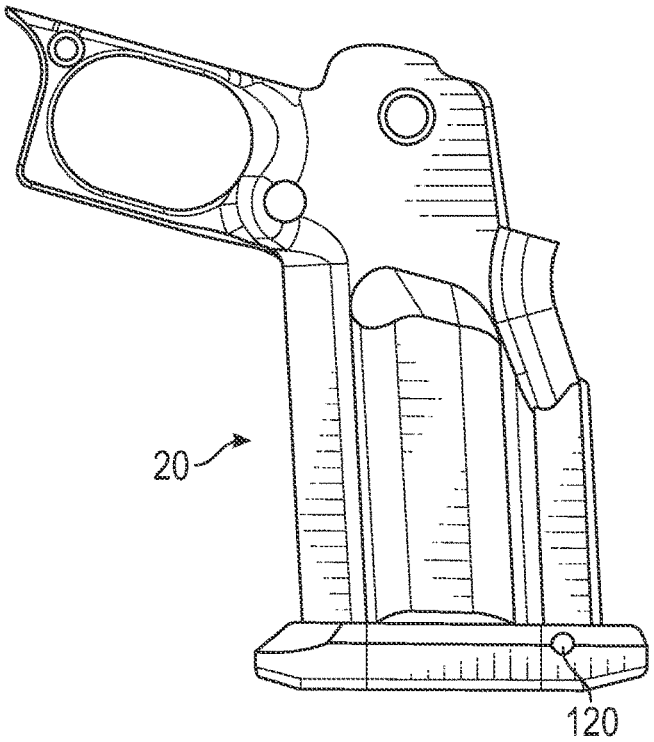
FIG. 4 shows a right side view of an assembled grip, grip panel, trim ring, and retaining pin.

Referring to FIG. 1 and FIG. 2, there may be a first recess 40*a* on a first side 42*a* of the modular grip 20 which may be capable of receiving first grip panel 52*a*, with a second recess 40*b* on a second side 42*b* of the modular grip 20 capable of receiving second grip panel 52*b*. First grip panel 52*a* may be removably affixed into the first recess 40*a*, and a second grip panel 52*b* removably affixed into the second recess 40*b*. Trim ring 60 may encompass the modular grip's 20 distal end 20*a*. A trim ring lip 65 may engage both with a first grip panel tab 70*a* on a distal end 72 of the first grip panel 52*a* and with a second grip panel tab 70*b* on a distal end 74 of the second grip panel 52*b*.

Figure 5:
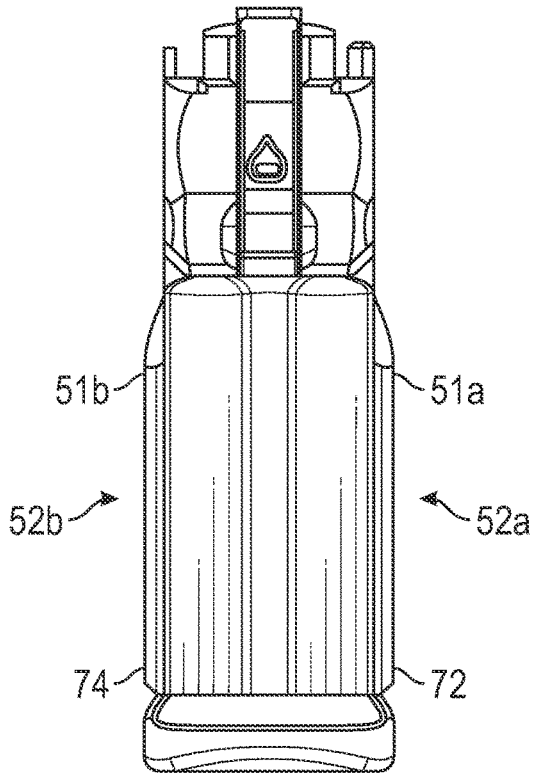
FIG. 5 shows a rear view of an assembled grip, grip panel, trim ring, and retaining pin.
Figure 6:
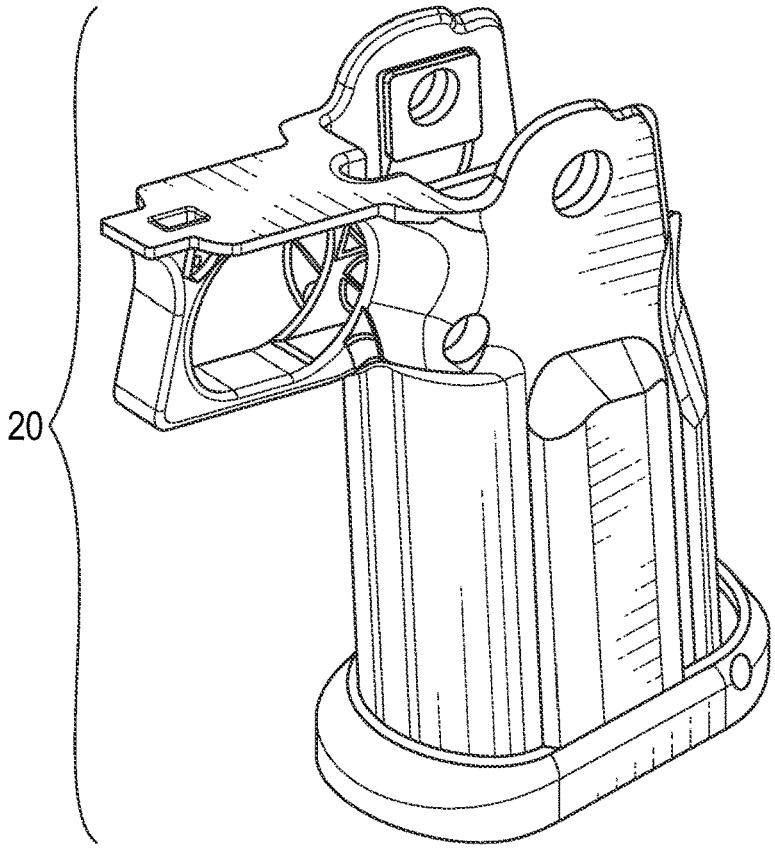
FIG. 6 shows an upper right perspective view of an assembled a grip, grip panel, trim ring, and retaining pin.
Figure 7:
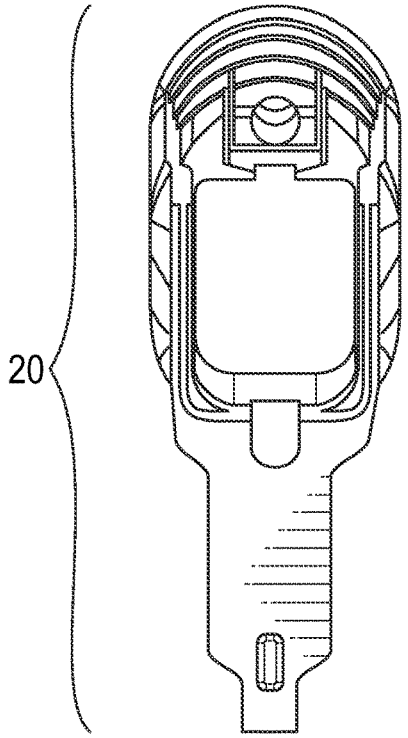
FIG. 7 shows a top view of an assembled grip, grip panel, trim ring, and retaining pin.
Figure 9:
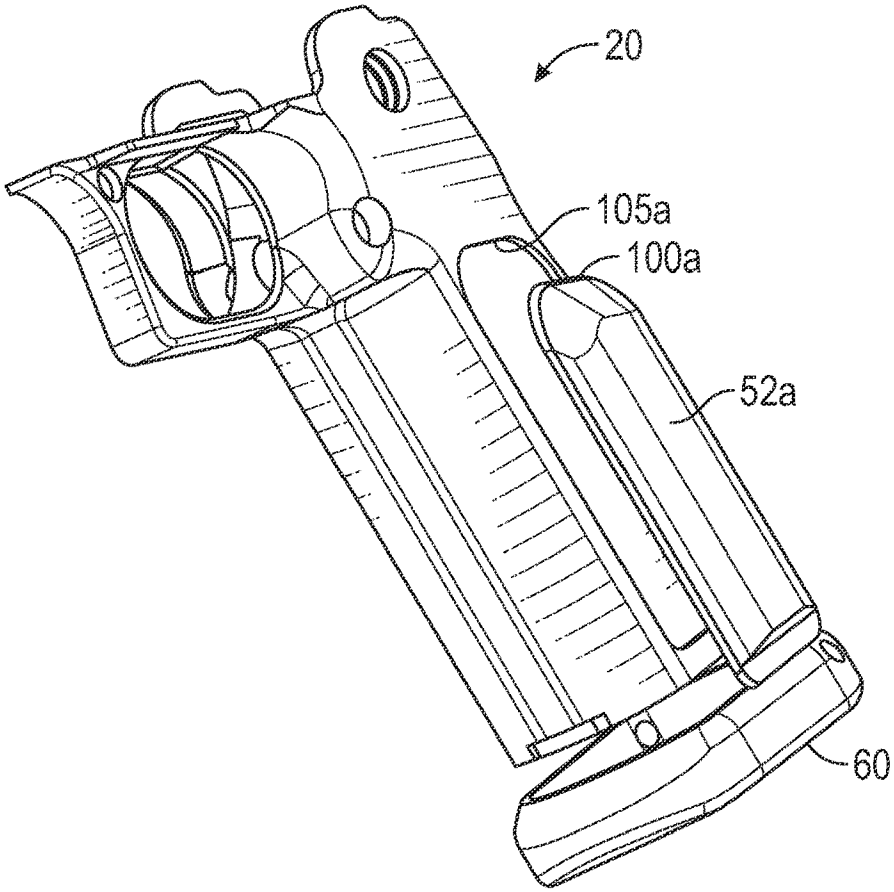
FIG. 9 shows an exploded right side perspective view of a grip, grip panel, and trim ring, illustrating a second step of grip panel insertion.

Also referring to FIGS. 5 and 9, the proximal end 51*a* of the first grip panel 52*a* may include a beveled surface 100*a* which engages with a corresponding undercut beveled surface 105*a* in a proximal end of the first recess 40*a*; and the proximal end 51*b* of the second grip panel 52*b* may include a beveled surface 100*b* which engages with a corresponding undercut beveled surface 105*a* in a proximal end of the second recess 40*b*. The modular grip 20 may include a grip tab 110 which engages with a grip tab recess 115 (shown in FIG. 23) on trim ring 60. Both the trim ring 60 and the modular grip 20 may contain coaxial holes 120 capable of receiving a retaining pin 125, and the retaining pin 125 may secure the trim ring 60 to the modular grip 20 in conjunction with grip tab 110 and grip tab recess 115.

FIG. 3 through 7 show additional views of modular grip 20, with additional parts such as grips panels 52*a* and 52*b*, trim ring 60.

Figure 8:
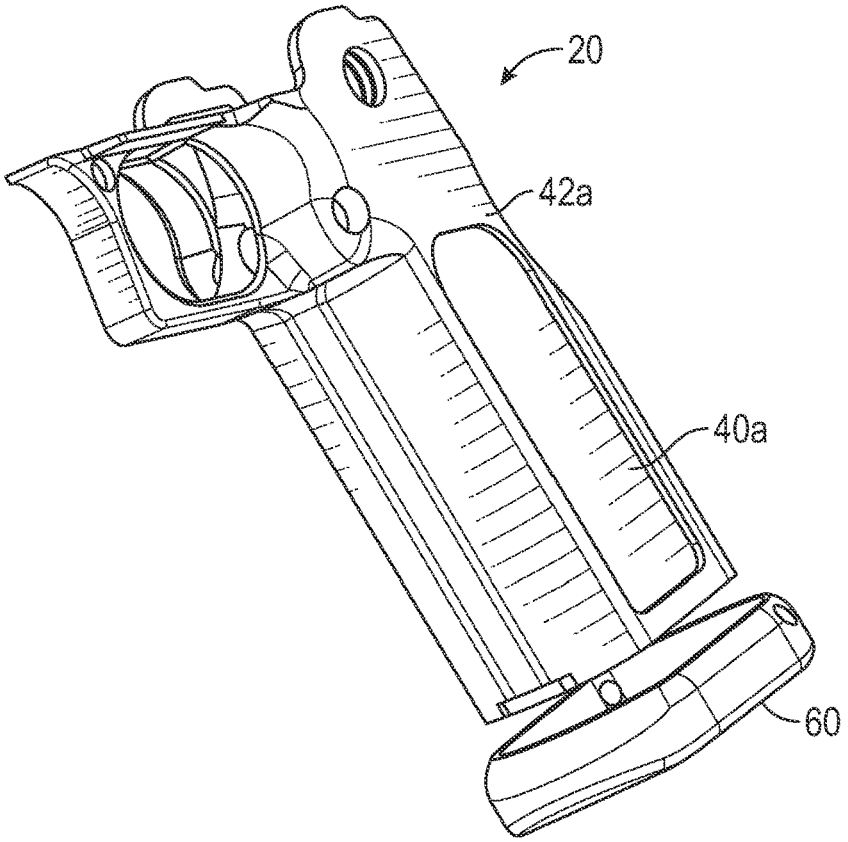
FIG. 8 shows an exploded right side perspective view of a grip and trim ring, illustrating a first step of grip panel insertion.
Figure 10:
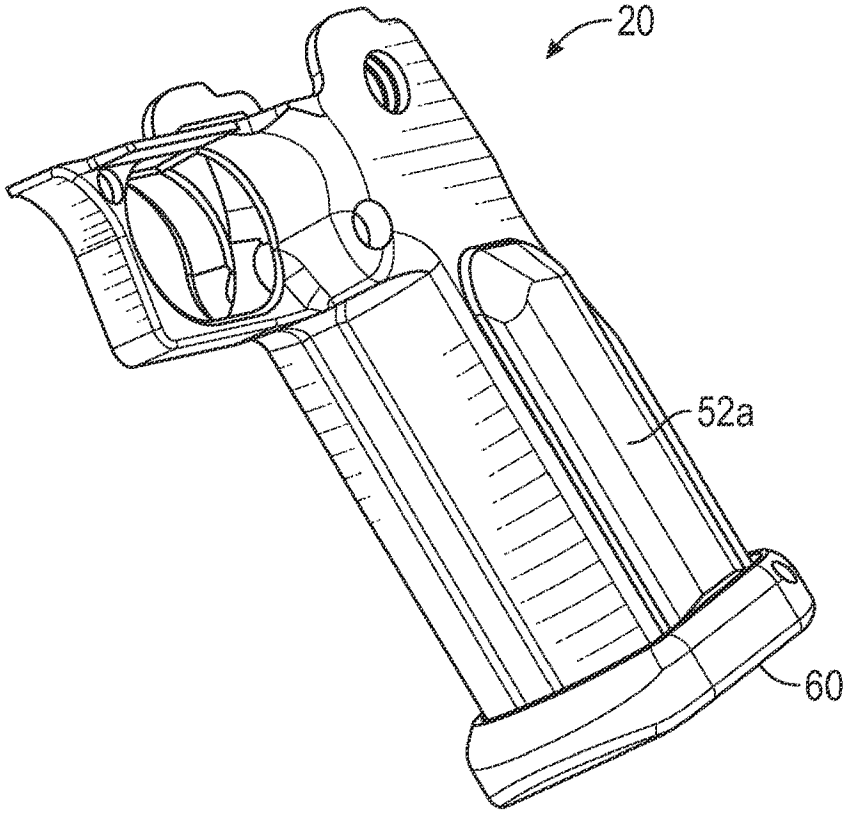
FIG. 10 shows an exploded right side perspective view of a grip, grip panel, and trim ring, illustrating a third step of grip panel insertion.

FIGS. 8 through 10 show an example of first grip panel 52*a* being removably affixed on to modular grip 20. FIG. 8 shows modular grip 20 without a grip panel present, with trim ring 60 shown in an exploded view position. First recess 40*a* is most visible in FIG. 8. FIG. 9 shows right grip panel 52A being positioned over first recess 40*a*, with trim ring 60 again shown in an exploded view position. FIG. 10 shows right grip panel 52*a* removably affixed into first recess 40*a*, with trim ring 60 shown in position to secure the distal end of right grip panel 52*a*, as will be further explained. The components and process for removably affixing second grip panel 52*b* to second side 42 is identical and not repeated in full for brevity.

Figure 13:
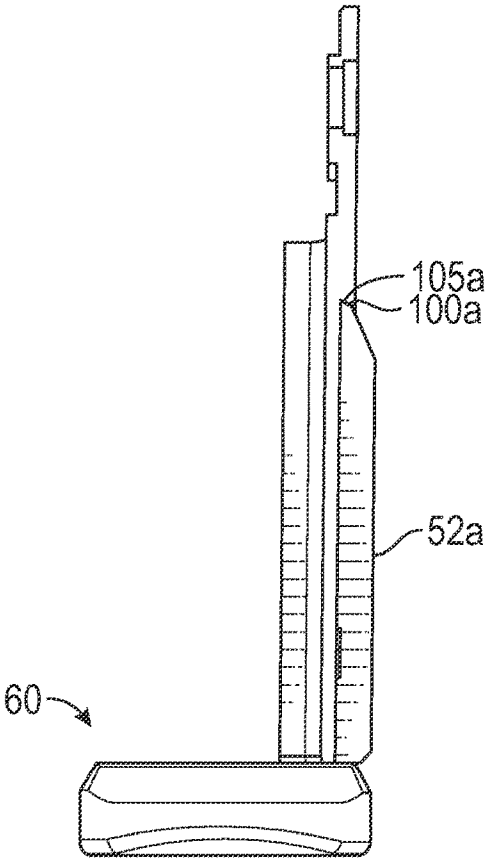
FIG. 13 shows a front cross section view of a grip, grip panel, and trim ring, illustrating a third step of grip panel insertion.
Figure 12:
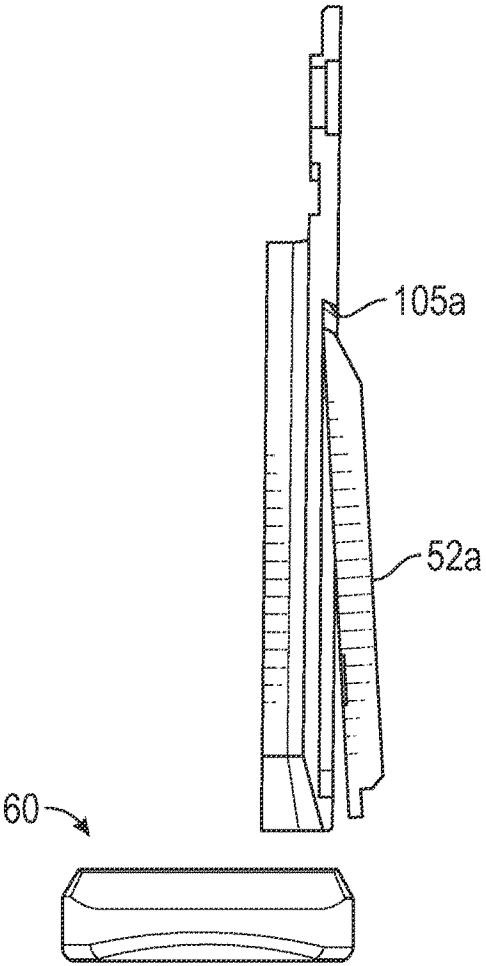
FIG. 12 shows a front cross section view of a grip, grip panel, and trim ring, illustrating a second step of grip panel insertion.
Figure 11:
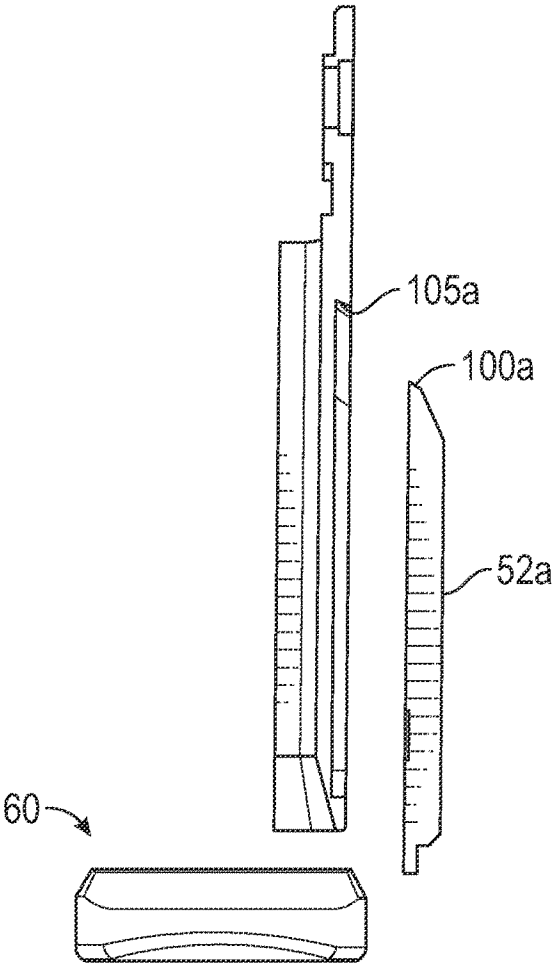
FIG. 11 shows a front cross section view of a grip, grip panel, and trim ring, illustrating a first step of grip panel insertion.

FIGS. 11 through 13 shows another view of an example of first grip panel 52*a* being installed on to modular grip 20. FIG. 11 shows right grip panel 52*a* being positioned over first recess 40*a*, with trim ring 60 shown in an exploded view position. Beveled surface 100*a* is shown at the proximal end 51*a* of right grip panel 52*a*; 100*a* mates with undercut surface 105*a* in right grip panel 52*a*.

FIG. 12 show the beveled and undercut surfaces allow panel 52*a* to only be removed or installed from below—that is, in the direction shown in FIGS. 11-13. The beveled surface 100*a* mating with undercut surface 105*a* prevents the proximal end 51*a* of first grip panel 52*a* from being removed from modular grip 20 without lowering the panel 52*a* relative to modular grip 20. FIG. 13 shows right grip panel 52*a* removably affixed into first recess 40*a*, with trim ring 60 shown in position to secure the distal end of right grip panel 52*a*, as will be further explained. The undercut surface 105*a* may be made with a 60 degree chamfer, likewise undercut surface 105*a* may be made with a corresponding negative 60 degree undercut, so that the two angled surfaces mate. Other appropriate chamfer angle may also be used.

Figure 15A:
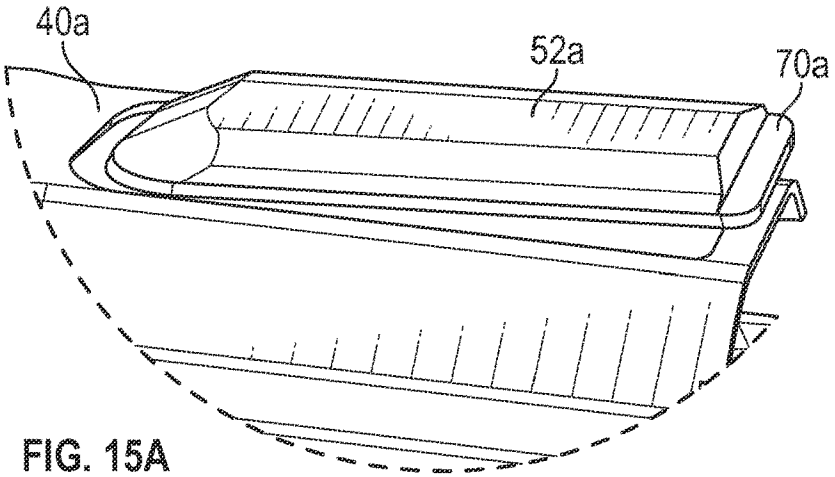
FIG. 15A shows an enlarged perspective of a grip and grip panel, illustrating a second step of grip panel insertion.
Figure 15:
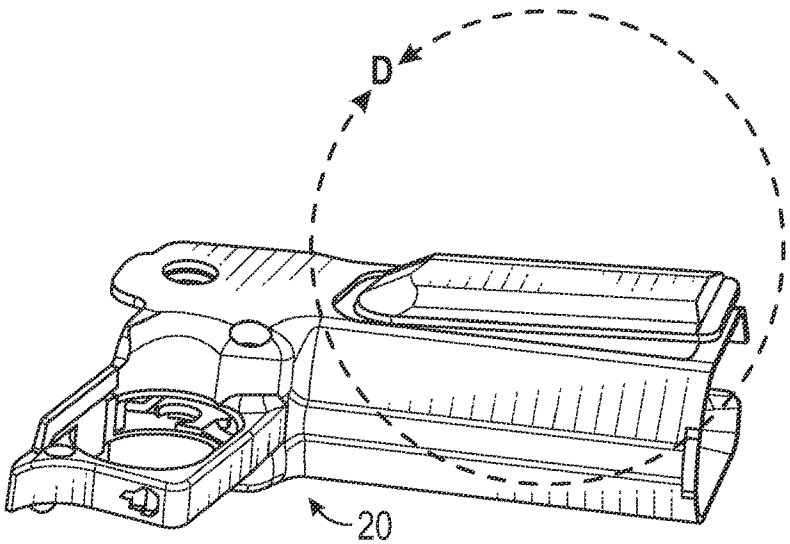
FIG. 15 shows an upper front right perspective view of a grip and grip panel, illustrating a second step of grip panel insertion.
Figure 14A:
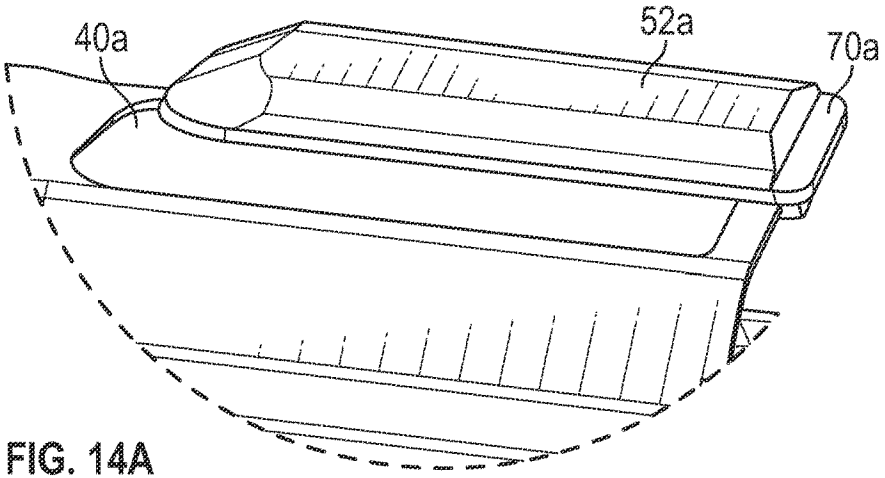
FIG. 14A shows an enlarged perspective of a grip and grip panel, illustrating a first step of grip panel insertion.
Figure 14:
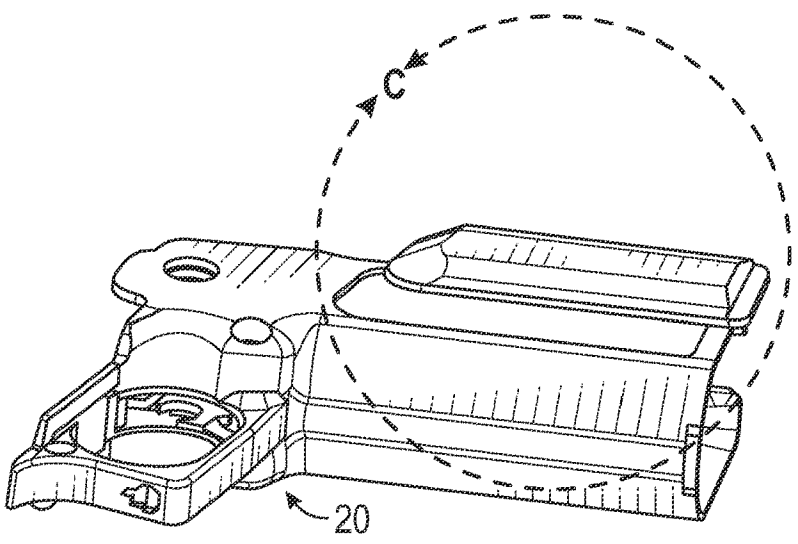
FIG. 14 shows an upper front right perspective view of a grip and grip panel, illustrating a first step of grip panel insertion.
Figure 16A:
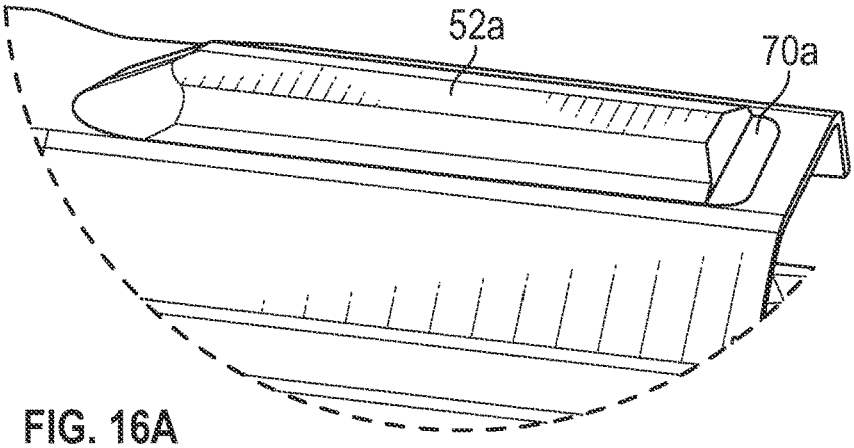
FIG. 16A shows an enlarged perspective of a grip and grip panel, illustrating a third step of grip panel insertion.
Figure 16:
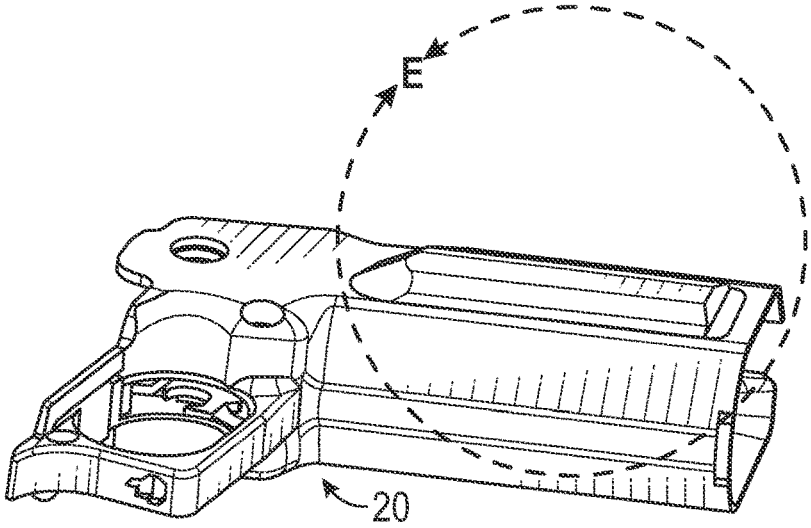
FIG. 16 shows an upper front right perspective view of a grip and grip panel, illustrating a third step of grip panel insertion.

FIGS. 14 through 16, with enlarged view insets 14A though 16A, show another view of an example of first grip panel 52*a* being installed on to modular grip 20, with the installation the same as shown in FIGS. 8 through 10, and as in FIGS. 11 through 13. FIGS. 14-16, with enlarged views 14A-16A, show first grip panel tab 70*a* on a distal end of 72 of first grip panel 52*a*. FIG. 16 shows the entire first grip panel 52*a* sitting flush within first recess 40*a*. The components and process for removably affixing second grip panel 52*b* to second side 42 is identical and not repeated in full for brevity.

Figure 17:
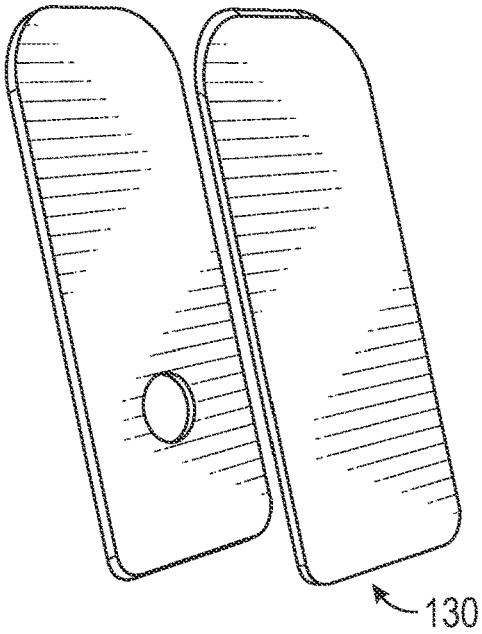
FIG. 17 shows an example of a flush-sized modular grip panel.
Figure 18:
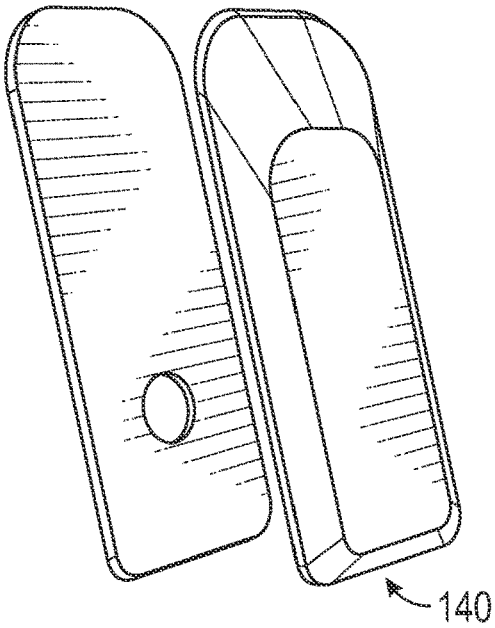
FIG. 18 shows an example of a large-sized modular grip panel.
Figure 19:
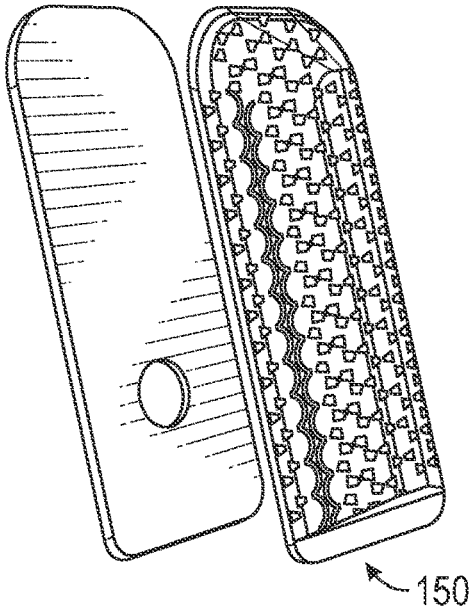
FIG. 19 shows an example of a large-sized modular grip panel with added texture.

FIGS. 17 through 19 show examples of three different grip panel types, such as first grip panel 52*a* and second grip panel 52*b*. Grip panels may be fabricated using different materials, including but not limited to metals, plastics, carbon fiber, and various composites. There also may be variations within each material type. A non-limiting example for metals may include various types of tungsten steel, chrome-molybdenum steel, stainless steels, aluminum, aluminum alloys, titanium (including different grades such as CP, 3/2.5, etc.), etc. Similar non-limiting examples of plastics include those which may be injection molded, those which may be thermo-formed, etc. Thus, grip panels may be manufactured, and then selected by the user, according to material type.

FIG. 17 shows a thin grip panel without a textured surface; FIG. 18 shows a medium thickness grip panel without a textured surface; and FIG. 19 shows a thick grip panel with a textured surface. Grip panels may also include different textures on outward facing side of the panel. Such textures may be desirable for different uses of a firearm, with some uses being better suited to a rougher or textured surface, while for other uses a smooth surface may be preferable. Thus, grip panels may be manufactured, and then selected by the user according to surface texture.

As different materials have different densities, grip panels may also be varied according to weight. Thus, grip panels may be manufactured, and then selected by the user, according to grip weight. Grip panels of different weights may also allow the end user to adjust the balance of the gun and potentially reduce recoil by adding weight to the non-reciprocating grip.

Grip size and shape, and therefore grip panel size, may also be significant for optimal fit of a user's hand to a firearm grip. Thus, grip panels may be manufactured, and then selected by the user, according to a grip panel's thickness and overall shape. A non-limiting example: a user with larger hands may select thicker grip panels, while a smaller-handed user may select thinner grip panels. Different embodiments may use different shapes for a grip panel, even among grip panels of the same thickness.

In one embodiment, the thickness of each of the first grip panel 52*a* and the second grip panel 52*b* is 0.063 inches, including the thickness of any textured surfaces; in another embodiment the thickness is 0.093 inches. including the thickness of any textured surfaces; and in another embodiment the thickness is 0.251 inches, including the thickness of any textured surfaces. There may be additional embodiments with thicknesses between any of the above thicknesses, or greater than the thickest dimension of 0.251 inches. In one embodiment, the depth of each of the first recess 40*a* and the second recess 40*b* is 0.063 inches.

Figure 20:
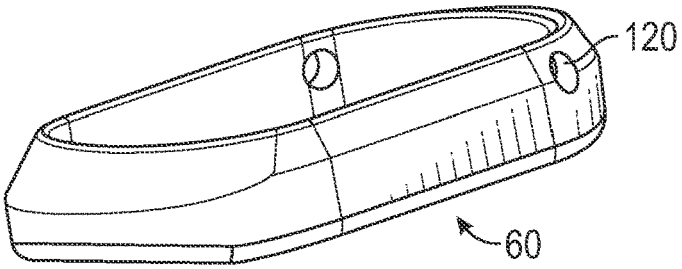
FIG. 20 shows an upper front right perspective view of a trim ring.
Figure 21:
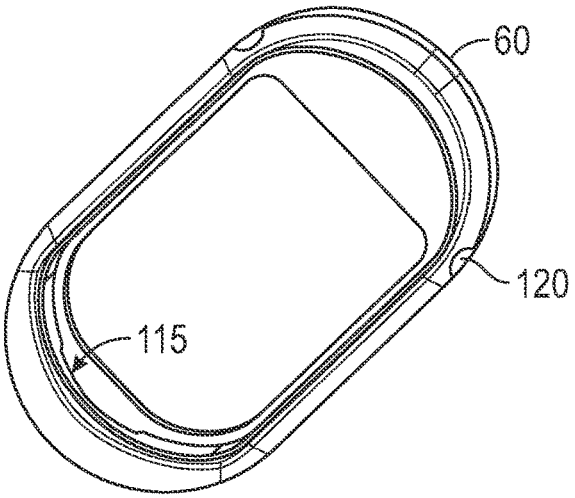
FIG. 21 shows a top view of a grip trim ring showing a grip tab recess for a grip tab.
Figure 22:
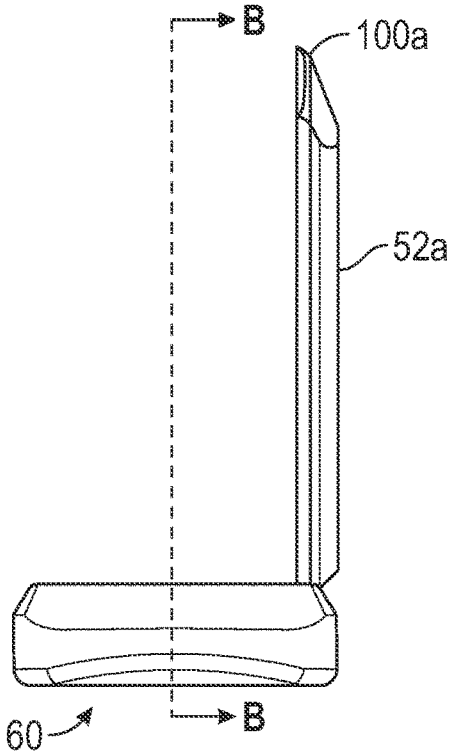
FIG. 22 shows a front view of a grip panel and grip trim ring in as-installed orientation.
Figure 23:
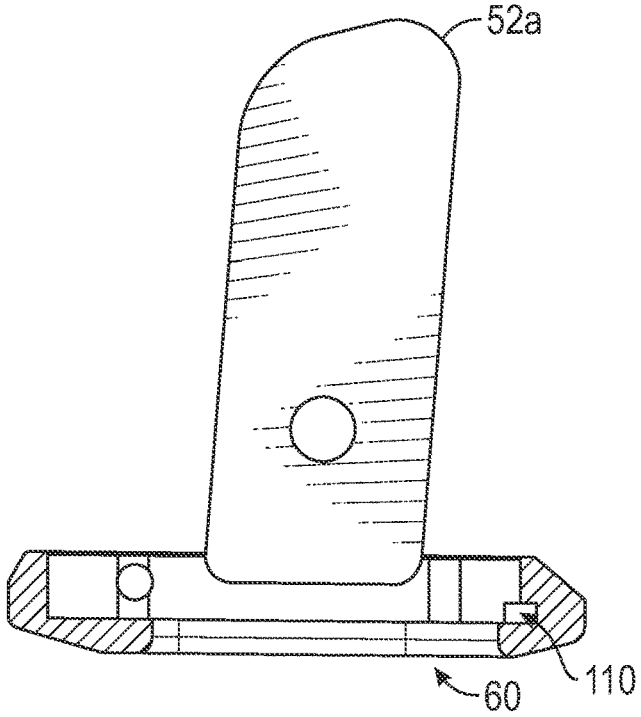
FIG. 23 shows a cross-section back view of grip panel, and grip trim ring, in as-installed orientation, with reference to FIG. 22.
Figure 24:
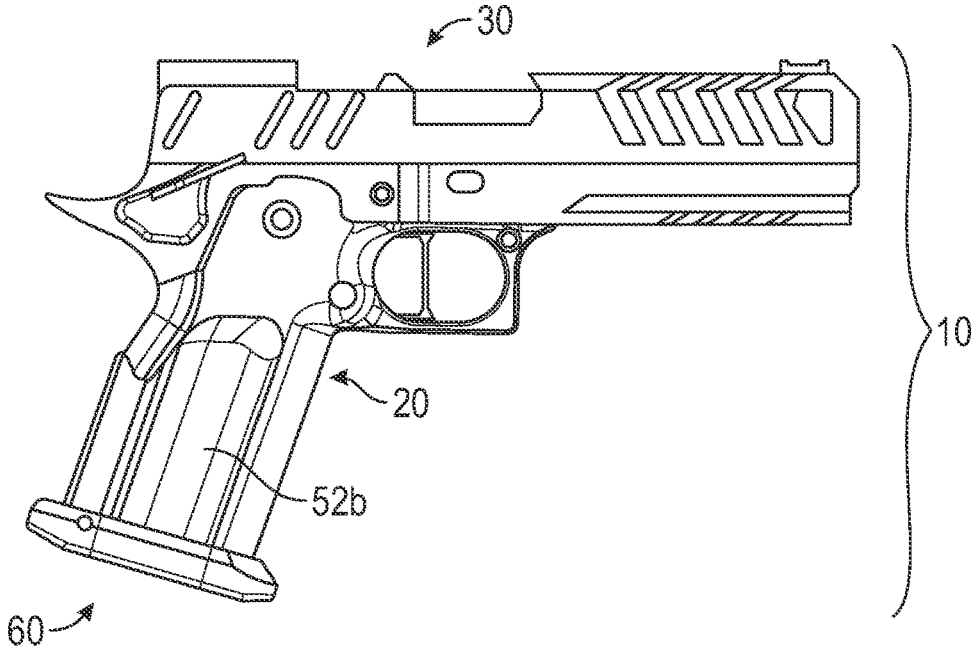
FIG. 24 shows a left-side view of overall assembled firearm, with a grip installed on a frame.

Affixing grip panels to a modular grip may be accomplished by inclusion of a trim ring at the distal end of the modular grip. FIG. 20-21 shows an additional view of trim ring 60; FIGS. 22-24 show additional views of trim ring 60 and first grip panel 52*a*. As shown in at least FIG. 21, a trim ring 60 may include a grip tab recess 115. A grip tab 110 may be included on modular grip 20, with the grip tab 110 mating into grip tab recess 115 when the trim ring 60 is installed on modular grip 20. Coaxial holes 120 may be present on both trim ring 60 and modular grip 20, allowing a retaining pin 125 Ias see in FIG. 2) to slide into holes 120 and affix the two pieces together. The fit of retaining pin 125 into holes 120 may be of such dimensions to allow the pin to be readily removed from the holes without the use of significant force; for example the tolerance is looser than that of an interference fit. In one embodiment, the clearance fit of pin 125 into holes 120 is 1/1000 of an inch. This may allow a user to readily remove the retaining pin 125 (and this the retaining ring and grip panels) with ordinary hand tools such as drift punch and hammer.

Thus, removal of retaining pin 125 from the coaxial holes allows trim ring 60 to swing down, disengaging grip tab 110 from grip tab recess 115, thereby allowing the trim ring to be removed from the modular grip. With the trim ring removed, the grip panels may then readily be removed. A trim ring lip 65 may be the portion of trim ring 60 which engages with first grip panel tab 70*a* and second grip panel 70*b*.

With reference to FIG. 24, there is an example of an embodiment of the present disclosure. A firearm device 10 may include a modular grip 20, detachable from a frame 30. The attachment of a modular grip to a frame may be accomplished by methods known in the art.

Some aspects of this detailed description, as well as views shown in the accompanying drawings, are of a first grip panel 52*a* which is removably affixed into a first recess 40*a* on a first side 42*a*. The opposing side of the modular grip 20, that is second side 42*b*, is a mirror-image of first side 42*a*. All related features are identical between first side 42*a* and second side 42*b* and correspond with each other, such as: second recess 40*b*, second grip panel 52*b*, second grip panel tab 70*b* on distal end 74, proximal end 51*b* of panel 52*b*, proximal end of second recess 40*b*, and beveled surface 105*b*. Descriptions and drawings equally applicable to both sides, with the first side 42*a* described as an example and detail for second side 42*b* not repeated for brevity.

Although the present invention has been described with respect to one or more embodiments, it will be understood that other embodiments of the present invention may be made without departing from the spirit and scope of the present disclosure. Hence, the invention is deemed limited only by the appended claims and the reasonable interpretation thereof.

We claim:

1. A firearm device, comprising:

a modular grip, detachable from a frame;

a first recess on a first side of the modular grip capable of receiving a first grip panel, with the first grip panel removably affixed into the first recess;

a second recess on a second side of the modular grip capable of receiving a second grip panel, with the second grip panel removably affixed into the second recess;

the first recess and the second recess positioned on opposing sides of the modular grip;

a trim ring which encompasses the modular grip's distal end;

and in which the trim ring is configured to be coupled to the modular grip by a grip tab engaging with a grip tab recess.

2. The firearm device of claim 1, in which a lip of the trim ring engages both with a first grip panel tab on a distal end of the first grip panel and with a second grip panel tab on a distal end of the second grip panel.

3. The firearm device of claim 1, in which a proximal end of the first grip panel includes a beveled surface which engages an undercut surface in a proximal end of the first recess; and a proximal end of the second grip panel includes a beveled surface which engages an undercut surface in a proximal end of the second recess.

4. The firearm device of claim 1, in which the modular grip includes the grip tab which engages with the grip tab recess on the trim ring.

5. The firearm device of claim 1, in which both the trim ring and the modular grip contain a coaxial hole capable of receiving a retaining pin, with the retaining pin capable of securing the trim ring to the modular grip.

6. The firearm device of claim 1, in which the firearm device is for a handgun or a rifle.

7. The firearm device of claim 1, in which the first and second grips panels are made from at least one material of plastic, metal, and carbon fiber.

8. A method of customizing a firearm device, comprising:

detachably mounting a modular grip to a frame;

removably affixing a first grip panel into a first recess on a first side of the modular grip, removably affixing a second grip panel into a second recess on a second side of the modular grip, the first recess and second recess positioned on opposing sides of the modular grip;

affixing a trim ring to the modular grip's distal end;

and configuring the trim ring to be coupled to the modular grip by a grip tab engaging with a grip tab recess.

9. The method of claim 8, in which a proximal end of the first grip panel includes a beveled surface and is engaged with an undercut surface in a proximal end of the first recess; and the proximal end of the second grip panel includes a beveled surface and is engaged with an undercut surface in a proximal end of the second recess.

10. The method of claim 8, in which both the trim ring and the modular grip contain a coaxial hole capable of receiving a retaining pin, with the retaining pin capable of securing the trim ring to the modular grip.

11. The method of claim 8, in which the first and second grip panels are selected to according to volume.

12. The method of claim 8, in which the first and second grip panels are selected to according to weight.

13. The method of claim 8, in which the first and second grip panels are selected to according to surface texture.

14. The method of claim 8, in which the first and second grip panels are selected to according to shape.

15. The method of claim 8, in which the first and second grip panels are selected to according to material.

16. The method of claim 8, in which the first grip panel and the second grip panel each have a thickness between 0.05 inches and 0.75 inches.

17. The method of claim 8, in which the first grip panel fits flush into the first recess and the second grip panel fit flush into the second recess.

18. A firearm device, comprising:

a modular grip, detachable from a frame;

a first recess on a first side of the modular grip capable of receiving a first grip panel, with the first grip panel removably affixed into the first recess;

a second recess on a second side of the modular grip capable of receiving a second grip panel, with the second grip panel removably affixed into the second recess;

the first recess and the second recess positioned on opposing sides of the modular grip;

a trim ring which encompasses the modular grip's distal end;

and in which a lip of the trim ring engages both with a first grip panel tab on a distal end of the first grip panel and with a second grip panel tab on a distal end of the second grip panel, the first grip panel tab and the first grip panel's backside forming a single planar surface, the second grip panel tab and the second grip panel's backside forming a single planar surface.

19. The firearm device of claim 18, in which a proximal end of the first grip panel includes a beveled surface which engages an undercut surface in a proximal end of the first recess; and a proximal end of the second grip panel includes a beveled surface which engages an undercut surface in a proximal end of the second recess.

20. The firearm device of claim 18, in which both the trim ring and the modular grip contain a coaxial hole capable of receiving a retaining pin, with the retaining pin capable of securing the trim ring to the modular grip.

* * * * *